United States Patent [19]

Parham

[11] 4,028,231

[45] June 7, 1977

[54] VACUUM TYPE COAL SEPARATOR

[76] Inventor: Harold D. Parham, R.R. No. 1, White Plains, Ky. 42464

[22] Filed: Oct. 8, 1975

[21] Appl. No.: 620,831

[52] U.S. Cl. ..... 209/457; 209/44; 209/491; 209/497; 209/501

[51] Int. Cl.[2] ..... B03B 5/24

[58] Field of Search ..... 209/44, 172, 172.5, 209/501, 457, 500, 490–492, 494–496, 455, 250, 157–161, 497

[56] References Cited

UNITED STATES PATENTS

| | | | |
|---|---|---|---|
| 133,606 | 12/1872 | Utsch | 209/457 |
| 1,067,410 | 7/1913 | Du Pont | 209/172 |
| 2,819,797 | 1/1958 | Woodhead | 209/455 |
| 3,071,447 | 1/1963 | Bernhardi | 209/159 X |
| 3,249,226 | 5/1966 | Watson | 209/172.5 |
| 3,662,885 | 5/1972 | Dorph | 209/161 |

*Primary Examiner*—Bernard Nozick
*Assistant Examiner*—Ralph J. Hill
*Attorney, Agent, or Firm*—Clarence A. O'Brien; Harvey B. Jacobson

[57] ABSTRACT

A device for circulating liquid by vacuum, that is carrying two or more particles of different densities. The particles are separated and then discharged through a discharge bowl to separate receptacles, and the liquid is returned for re-use.

14 Claims, 8 Drawing Figures

AIR PUMP

VACUUM TYPE COAL SEPARATOR

BACKGROUND OF THE INVENTION

1. Field of the Invention

This invention relates generally to a device for separating particles having different specific densities from each other. It has specific application in the separation of coal from other materials.

2. Description of the Prior Art

A common problem of known prior art devices has been that they fail to completely separate the desired materials from the undesired materials. Another problem has been that in the case of water or liquid being used in the process of separation, large quantities of same have been required. This in many instances has limited the use of the devices to areas where large quantities of water are readily available. It is highly desirable to have a separator which will almost completely remove the debris material from the desired material and also be conservative of the use of the liquid involved.

The prior art teaches a number of different types of separators such as the rubber separator to Askam, U.S. Pat. No. 572,854 and the patent to Phipps, U.S. Pat. No. 3,456,789 for grading solid particles in a liquid suspension. Other known patents for separating classifying ores or a liquid suspension are taught by U.S. Pat. Nos. 327,766; 1,163,876; 1,511,643; 2,533,074; 2,919,024; and 2,696,298. None of these separators teach the new and novel device as disclosed by this invention.

Other known separators specifically for use in separating coal from other debris are taught by U.S. Pat. Nos. 528,803; 1,737,410; 2,058,374; 2,823,801; 2,521,152; and 2,660,305. Known prior art involving separation by the use of air or vacuum are shown in U.S. Pat. Nos. 447,027; 3,250,389; 3,374,505; 3,685,651; and 3,804,245. While the above-listed patents may be pertinent to the disclosed invention, none of them show the combination as disclosed in this application.

SUMMARY OF THE INVENTION

An object of the present invention is to provide a separator device of the vacuum type for separating particles of different densities.

Another object of this invention is to provide a separator which uses liquid in addition to vacuum and once the particles are separated discharges them into separate areas, and then returns the liquid for re-use.

A further object of this invention is to provide a separator device which is conserving in the use of the liquid used in the separating process.

A still further object of this invention is to provide a separator which does a better and more complete job of separating the particles of different densities.

One of the advantages of the particle separator disclosed by this invention is that it will separate particles of different densities in a better manner, and with greater selectivity than known prior art devices. The device disclosed herein is also more conservative of the liquid used in the separation process than known prior art devices. Also by the use of vacuum in the process a much more efficient and better operation is achieved.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 2, 7:
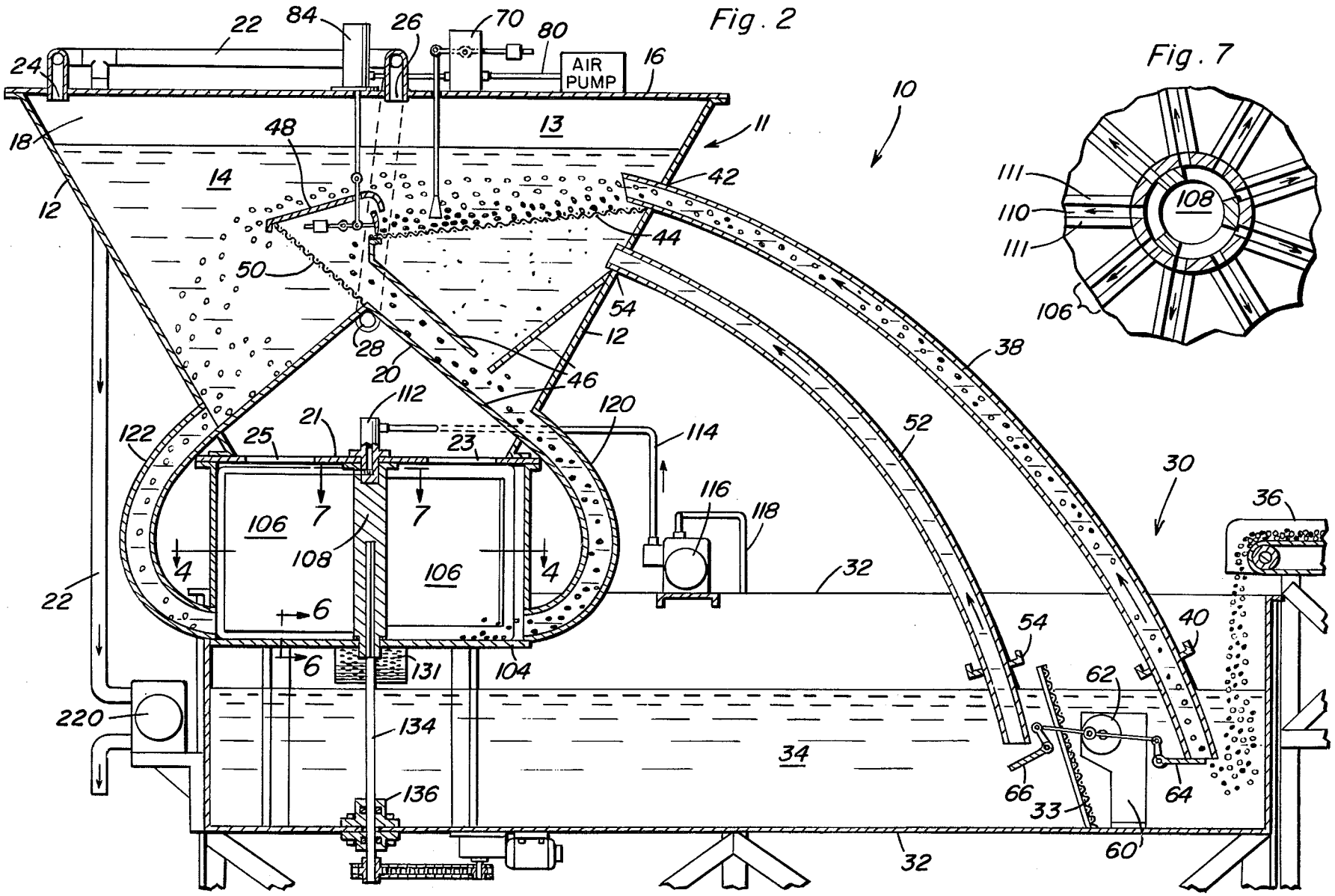
FIG. 2 is a cross-sectional, elevational view, taken generally along line 2—2 of FIG. 1.
FIG. 7 is a detail enlarged, in cross section, taken generally along line 7—7 of FIG. 2.

Referring to FIG. 2 of the drawings, reference numeral 10 indicates the overall vacuum type coal separator of this invention. One of the important units of this device is the main hopper unit referred to by numeral 11. This separator hopper unit has substantially vertical, sloping side panel members 12 suitably welded or otherwise secured to vertical side panels 13. A top plate 16 encloses the upper portion of this separator unit and sloping sheets 20 and flat base plate 21 enclose the bottom portion of same. Basically this separator hopper structure is air-and-water tight, and in normal use there is a vacuum portion at the upper part thereof indicated by reference numeral 18 and a liquid, normally water, is in the lower portion of the unit as shown by reference numeral 14.

A vacuum is maintained on the separator hopper unit 11 by means of a vacuum pump 220 and a vacuum line 22 which is attached at various points such as 24, 26, and 28 to the separator hopper unit.

Another important unit of the overall device is the mixed particle input feed unit labelled by reference numeral 30 in FIG. 2. A basic part of this unit is the open top basin 32 which normally will contain the liquid which is used in the separation process. A suitable amount of the liquid (usually water) is shown labelled 34. An input conveyor means 36 feeds in the unseparated particles to the far right of the tank 32. The particles may, for example, be coal, slate, and rock particles and the combined mix drops into the liquid for the initial wetting of said particles. A feed pipe 38 suitably supported by a bracket 40 on the inner side wall of the basin 32 and through a leak sealed hole 42 in the wall 12 of the separator hopper unit 11 is used to convey the liquid and unseparated rock, slate, and coal particles upwardly to the hopper unit. Mounted inside the hopper unit is a screen member 44 so positioned as to receive the particles thereupon. Heavy solid particles that are quite small will pass through this screen 44 and fall into the hopper section for small heavy solids which is formed inside the main separator hopper unit by additional baffle plates 46 and walls 13 as best seen in FIG. 2. Another baffle plate 48 having a double flange shape as shown in FIG. 2 is also provided within the main separator hopper unit. A further screen unit 50 for passage of liquid therethrough while blocking rock particles is also placed as shown in FIG. 2. A second liquid feed pipe for additional lift to the combined particles is provided by means of pipe 52 suitably supported within the housing 32 by means of bracket 54 and passing through another no-leak hole 54 in the panel 12 of unit 11. This second pipe will allow feed water to flow within the chamber formed by baffles 46 and screen 44 and impart a lifting action to the particles above said screen. This aids greatly in the separation of the heavy and light particles which are directly above the screen 44. The lighter particles, such as coal, tending to be floated and washed up and over the double flange plate 48 into the other section of the hopper.

Within the basin 32 is a separator screen 33 which prevents the particles entering the right-most area of the basin unit 32 from passing to the left portion of said unit, and yet allowing liquid flow between both portions. Additional means are provided in the basin to cause a pulsating flow of the liquid in pipes 38 and 52. This means consists of a motor-driven eccentric cam 62 suitably mounted on a bracket 60 within the basin unit 32 and connected by appropriate linkage to suitable valve plates 64 and 66. As can be seen in FIG. 2, when one of the valve plates, i.e. 64 is substantially closed, there being a small opening always provided at the end of said valve plate to allow at least a small flow through pipe 38, the other valve plate 66 is in the full open position. As can readily be visualized when the cam eccentric 62 rotates so that valve plate 66 is closed then valve plate 64 will be open, and vice versa. Thus through the operation of these valve plates and eccentric mechanism a pulsating flow of liquid and particles will occur in pipe 38 and a pulsating flow of liquid only in pipe 52.

Figure 5:
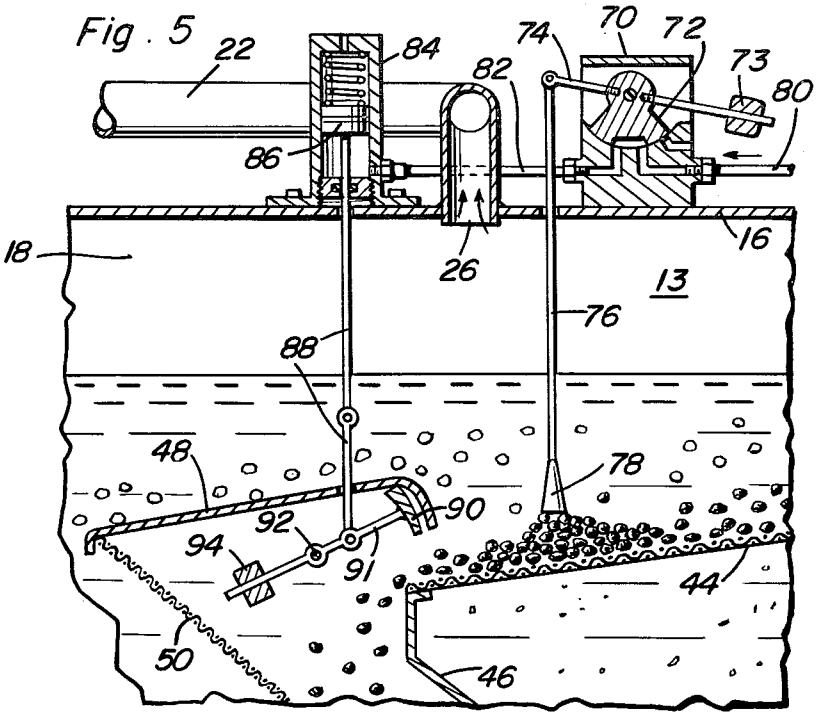
FIG. 5 is an enlarged cross-sectional view in elevation of the upper portion of the main housing shown in FIG. 2.

As can best be seen in FIGS. 2 and 5, the first couple of stages of operation of this separator device will be described. As mentioned above a vacuum line 22 through openings 26 and 24 keeps the upper part of the hopper unit 11 under vacuum and creates the flow of liquid through pipes 38 and 52. As mentioned before the flow of liquid through pipe 38 also carries with it combined particles, as for example coal, slate, rock, etc. for separation. In the case of coal and contaminants therewith it is desired to obtain the usable coal and separate the unburnable slate and rock particles so they can be used for other things. In the drawings the dark shaded particles indicate rock, shale, and other undesirable particles while the light particles indicate the good or usable products, in this example, coal. An initial separation takes place within the unit 11 when the small solid particles fall or pass through the screen 44 into the hopper therebelow and then on down into the bottom of the unit as shown. The other heavy, large, but undesirable solids are retained by the screen 44 and tend to accumulate thereon. Mechanism is provided to periodically allow these undesirable heavy solids to pass on to the lower portion of the unit. This mechanism, best seen in FIG. 5, consists of the following. An air valve 70 is mounted on the top plate 16 controllable by means of lever 74 suitably pivotally hinged to float arm 76 to actuate a center valve unit 72. A counterweight 73 is provided at the end of arm 74 for suitable adjustment. An air pressure line 80 is connected to the input of said valve 70 and an output pressure line 82 is in turn fed to pneumatic cylinder 84 having an air piston 86 therein. This air piston 86 is suitably connected through linkage 88 to a pivot arm 91 supporting solid particle gate 90, said arm 91 pivoted at point 92 and counterbalanced by weight 94. When screen 44 accumulates a large amount of heavy solid particles, such as presently shown in FIG. 5, the tapered cone 78 is held up raising the lever 76 and moving pivot lever 74 to open the valve 72 to the air pressure line 80. Air pressure then passes through line 80, through the valve 72, through line 82 to the lower side of piston 86 to raise said piston (as shown), to open the rock gate 90. The operation is as follows; when the tapered cone 78 is forced upward as the force of water comes in through feed tube 52, the water picks up the bed of rock just clear of screen 44, and as the rocks settle back on the screen 44 the float 78 comes down a little slower than the rock causing the float to stop on top of the rock bed. So when the rock bed gets to a desired depth it holds valve 70 open to operate the rock gate 90. The up and down fluctuations of float 78 open valve 70, 72 to the air pressure, but due to the small size of lines 80, 82, the pressure buildup of piston 86 is insufficient to actuate same. However, once the level of rocks builds up to the desired depth as above, then the pressure will become sufficient to raise piston 86 which is spring-biased to the down position. Also, while line 80 is described as being connected to a pressure source, vacuum, which is already available, could just as easily be used with appropriate changes in the valve 70 and cylinder 84. Once the rock gate is open, as shown in FIG. 5, a good portion of this heavier material would then be passed through the gate and on into the lower portion of the housing unit. FIG. 2 shows the rock gate closed and the air valve 70 also in the closed position.

Figure 1:
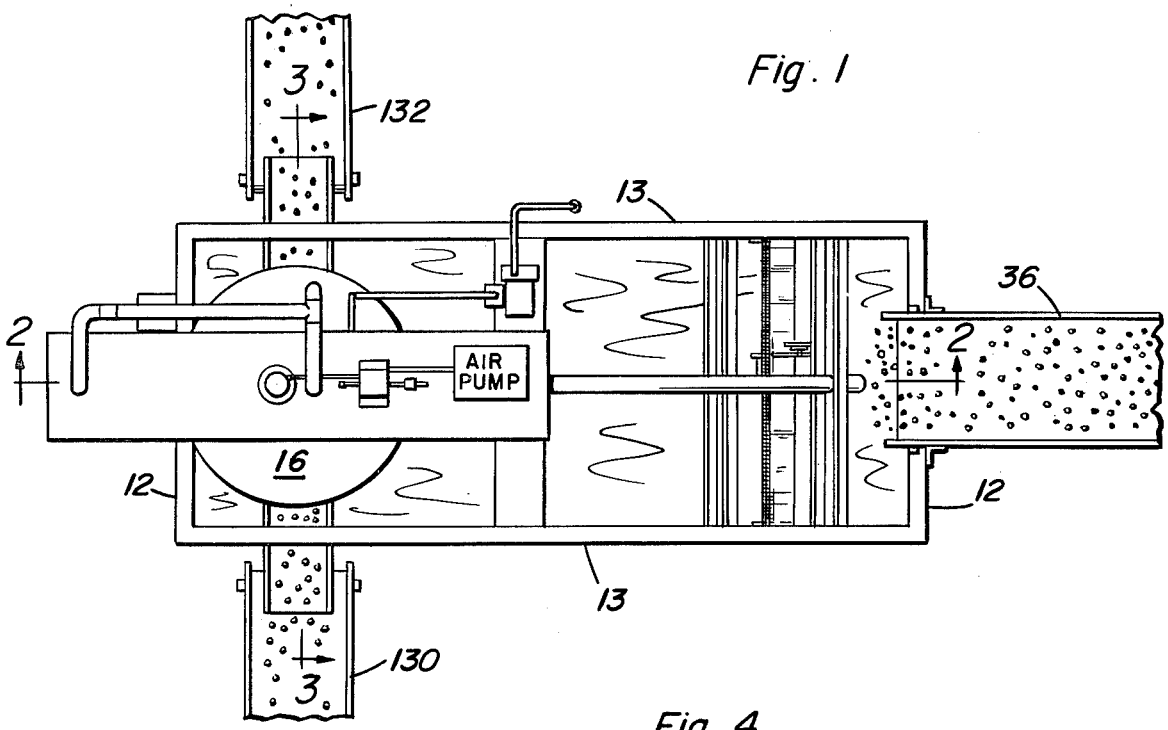
FIG. 1 is a top plan view of the overall device.
Figure 4:
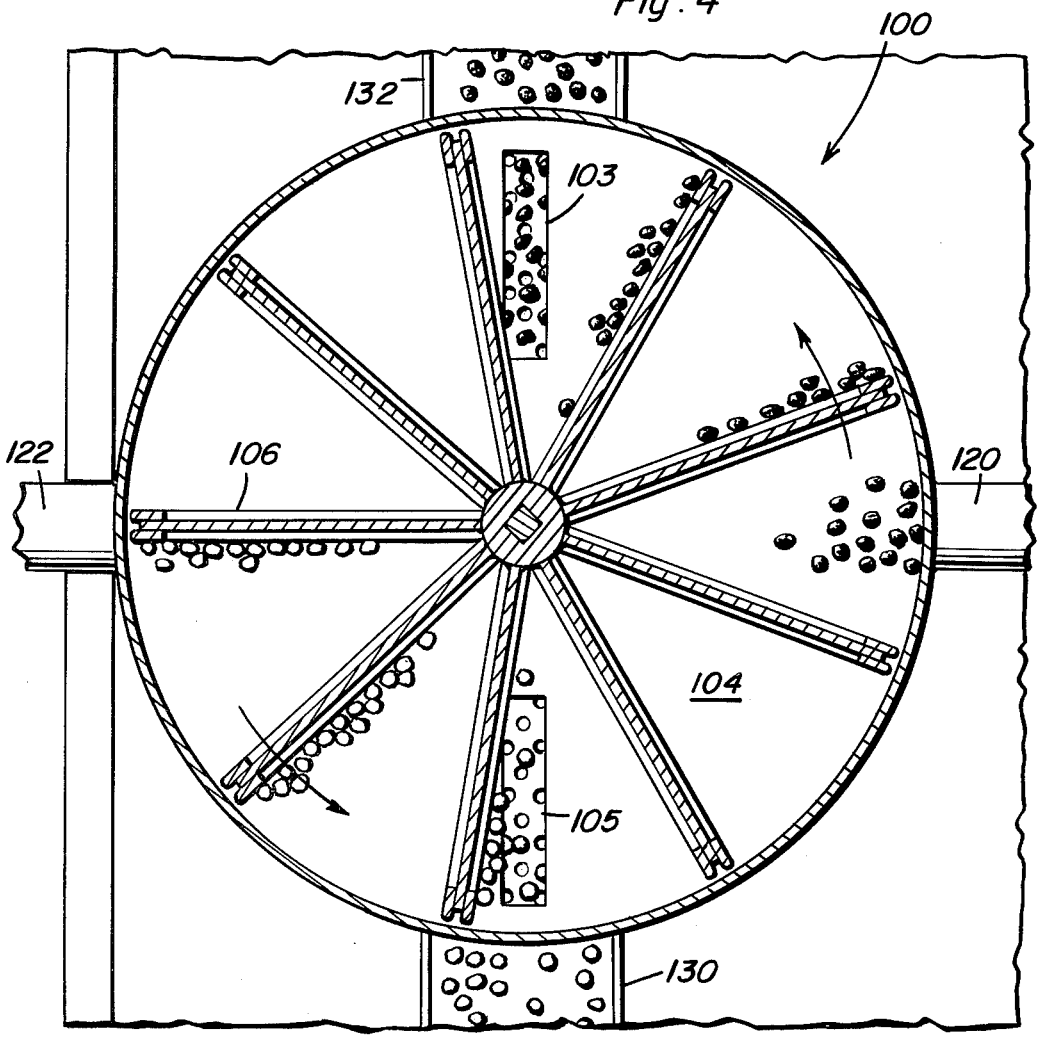
FIG. 4 is an enlarged cross-sectional view taken generally along line 4—4 of FIG. 2.
Figure 6:
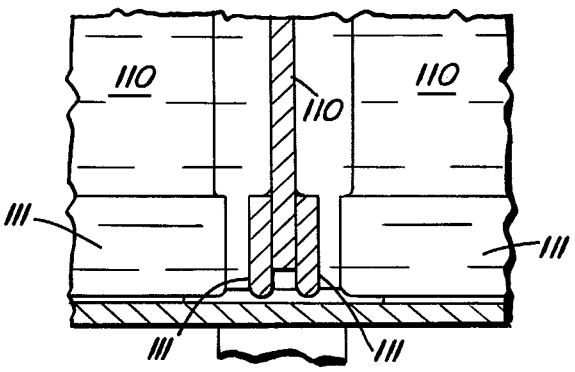
FIG. 6 is a small detail, enlarged, cross section taken generally along line 6—6 of FIG. 2.
Figure 3:
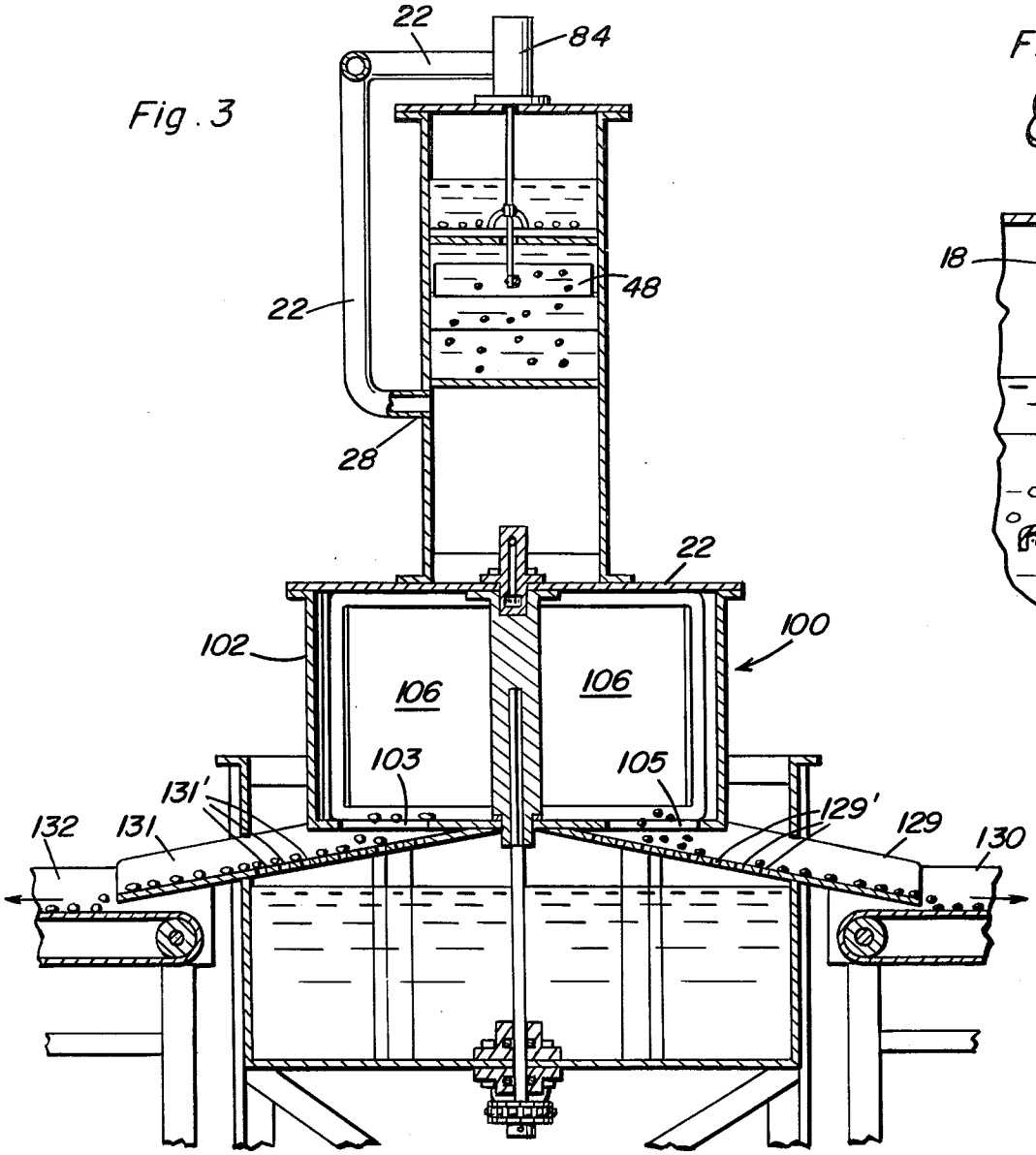
FIG. 3 is an end, cross-sectional view taken generally along line 3—3 of FIG. 1.

Another important unit of the separator of this invention is labelled by reference numeral 100. This unit is a discharge bowl having paddle blades inside thereof. The overall bowl consists of a container 102 mounted on the base of the main separator hopper 11. Base plate 21 is a common member between the bottom of the main separator and this discharge bowl unit. The base plate 21 has openings 23 and 25 therein as best seen in FIG. 2. The bottom plate 104 of the discharge bowl has similar openings 103 and 105 which are displaced 90 degrees from the position of openings 23 and 25. The paddle blades are labelled by reference numeral 106. These blades 106 are composite in form. As best seen in FIGS. 4, 6, and 7 the blades 106 have three parts thereto. As seen in FIG. 6, the inner portion 110 is a full solid section with shorter solid outer portions 111. The blades are so designed and constructed that water flow from the inside hub portion under pressure will escape along the gap at the edges of each blade because of the slight separation between the two solid portions 111. The gap at the lower edge of the blades are larger in square inches than the upper edges of the blades. The purpose of this being that a greater flow will exit out the lower edge of the blades and this will create a lift which will support the blade assembly on a cushion of water and eliminate friction as the paddle wheel turns within the bowl housing. The escape of water from between the space of the main blades and the outer edges also creates a seal and sweeping cleaning action on the outer edges of said paddle blades. The construction of the center hub 108 is not material as long as it permits water under pressure to be fed to the inner portions of the blade assemblies 106. Both the bottom and upper end of the hub 108 are mounted on suitable bearings within the bowl assembly unit. This water is applied on the central hub at the fitting 112 as shown in FIG. 2 and water under pressure is fed through line 114 from water pump 116 which is picking up water through input 118. Any type of normal water pump may be used for pump 116. This is the means whereby additional liquid is applied to the over-all system since there will be a certain amount of wastage through evaporation, splashing, etc. Excess water in the discharge bowl can drain off through openings 103 and 105 at the bottom 104 of the bowl assembly. Screen-like openings 129' and 131' in the bottom of the troughs or chutes 129 and 131 respectively allow this water to return to basin 32.

Input channels are provided between the lower bottom sections of the main separator hopper 11 such as 120 and 122, best seen in FIG. 2. The right channel 120 will feed the heavy solid material which has been separated from the coal into the bowl portion as shown, and the left channel 122 will feed the separated coal into the left side of the bowl. As the paddle blades make their rotation they will sweep the rocks and coal which have been appropriately deposited in the bottom portions of the bowl housing around until they come to the openings 103 and 105 at which time they will drop through said openings onto conveyor belts 130, 132.

The paddle blades are rotated by means of a shaft 134, either splined or square shaft engaged with the central hub 108. This shaft 134 is suitably mounted in bearings 136 at the bottom of the container 32. A watertight seal is also used to prevent leakage at this point. This shaft is chain driven from a motor driven reduction unit so that the shaft 134 will rotate at a slow speed of rotation. 18-½ revolutions per minute has been found to be a good speed. Other speeds, slightly faster or slightly slower may be more desirable depending upon the material being separated.

Discharge openings 103 and 105 at the bottom of the discharge bowl have conveyor chutes 129 and 131 mounted beneath them which feed into the conveyor systems generally indicated at 130 and 132. These conveyor systems are similar to the input conveyor 36 described above and are basically side plates having rotatable mandrels at each end thereof with a conveyor belt stretched between said rotatable mandrels and appropriate drive means, not shown, connected to the mandrels so as to drive them at proper conveyor speed.

FIG. 6 which is taken along a cross-sectional portion of a paddle blade shows the wide channel at the bottom of said paddle blade which exerts the lift on the paddle blade assembly. As described above this channel is about twice the size of the channel along the upper edge of the paddle blade.

Continuing with the description of operation, as can be seen best in FIG. 2, when the shale and rock particles are separated from the coal in the main separator housing 11 they will be conveyed through the feed tube 120 into the discharge bowl unit and swept approximately 90 degrees from their entry point into the discharge opening 103, as best seen in FIG. 4, for exit through channel 131 having holes 131' therein and out onto conveyor belt 132 to an appropriate discharge container or pickup device. Similarly the coal, which is the desired product in this example, will pass through feed tube 122 into the discharge bowl and be swept along, as best seen in FIG. 4, until the desired coal reaches discharge opening 105. It drops through said opening onto chute 129 having holes 129' therein and then onto conveyor unit 130 for discharge and pickup in appropriate receptacles. The holes 129' in chute 129, and holes 131' in chute 131 are provided to permit the water with the particles and coal to return to basin 32 for re-use, thus conserving said water. Of course, screens (not shown) rather than holes may be used with the chutes for the same purpose.

As can be seen from the foregoing description the disclosed device has a number of unique and novel features. These are combined to produce a separator which is very conserving of liquid and does an excellent job of separating coal from rock and shale, and/or other desirable particles from undesirable particles.

Figure 8:
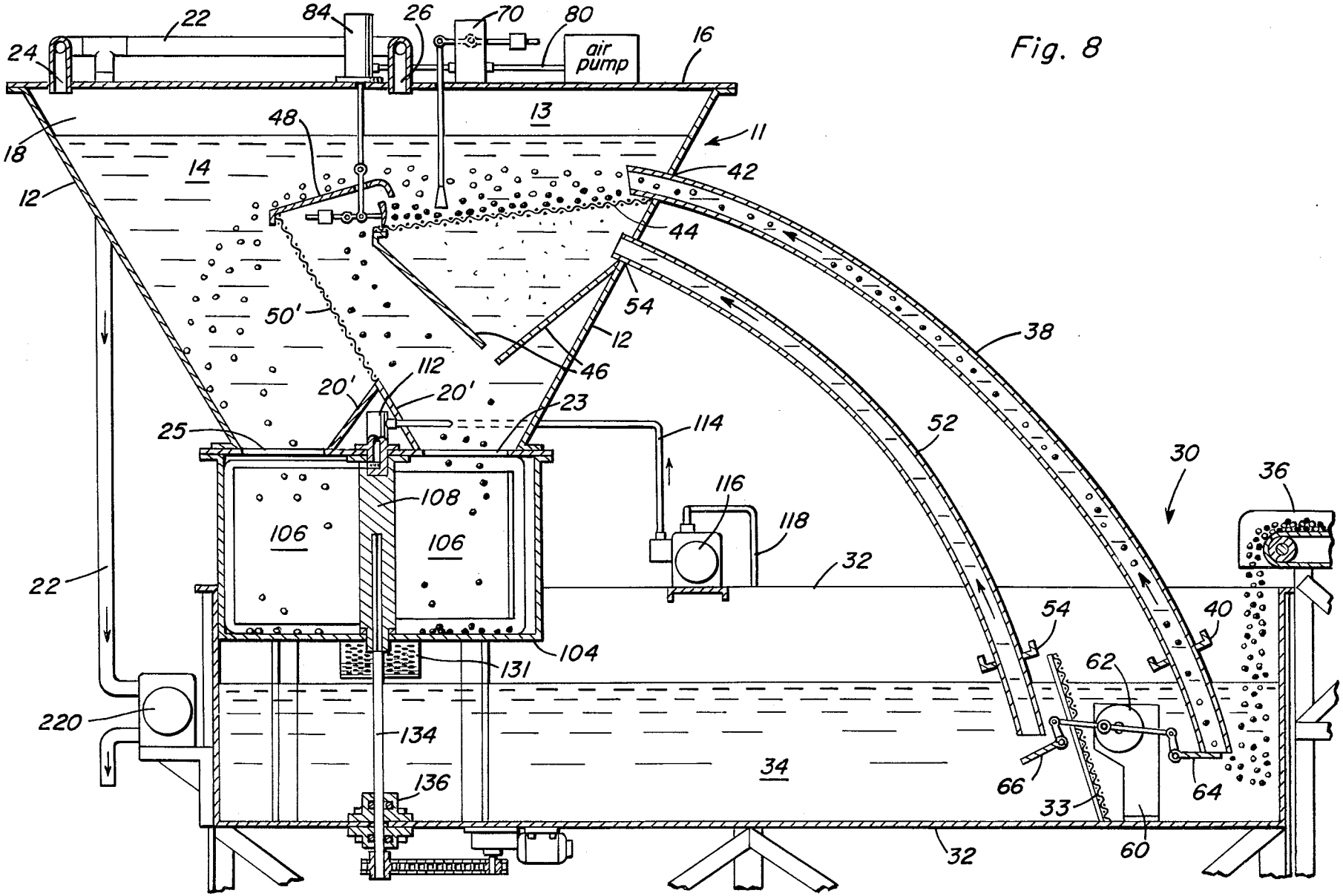
FIG. 8 is a cross-sectional, elevational view showing a modified embodiment of the separator device of this invention.

Another modification of this device may be built by eliminating the panels 20 in the separator hopper unit 11 and also eliminating the suction point 28 where said panels join at the top. Also the feel tubes 120 and 122 in this modification would be eliminated FIG. 8 shows this modification. As thus modified the panels 20 would be replaced by smaller baffle means 20' shown in FIG. 8. A screen 50' would block the passage of the separated particles between the separator 48 as presently connected and the apex of the panels 20' again as shown in FIG. 8. In this modification the separated particles would pass through the openings 23 and 25 at the bottom of the separator housing and at the top of the discharge bowl and paddle wheel device. The basic operation of the over-all device would still be substantially the same as described previously. The only substantial difference being that the upper portion of the discharge bowl paddle wheel device would not be under a vacuum, but would be entirely immersed in liquid.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A coal and rock separator using water and vacuum comprising: means for separating undesired particles from desired particles including; a main separator hopper for holding water and having two separate compartments therein, one for receiving rock, and the other for receiving coal; a vacuum source connected to the top portion of the separator hopper for maintaining a vacuum in the hopper; input means to allow water and a coal-rock mix to be fed into the separator hopper; a permeable support means mounted in the hopper for receiving said coal-rock mix; means for introducing a pulsating flow upwardly through the support; means for dividing the material stratified thereby into two fractions; and discharge means at the bottom of the main separator hopper to prevent reverse water/airflow into the hopper while permitting separate discharge of the coal and rock as separated therein.

2. The device of claim 1 wherein the discharge means includes a cylindrical tub-like container connected to the bottom of the hopper for receiving the separated coal and rock particles; and paddle blades rotatable within said container.

3. The device of claim 2 with the discharge means further including connecting feed tubes between the separate compartments of the main hopper and the lower portion of the cylindrical container.

4. The device of claim 2 with the discharge container including fresh water feed input means for continually supplying water to the system.

5. The device of claim 4 wherein at least one of the paddle blades rotatable within the container comprises a three part composite blade having a main blade portion separating two other blade members, the spaced edges of the two other blade members thus forming a water flow channel between the two members and the fresh water input means is applied to a rotatable center hub for the composite paddle blade structure for feeding a continuous flow of water along the water flow channels so formed at the edges of said paddle blades.

6. The device of claim 2 wherein the discharge means is connected to the separate compartments of the hopper by means of slots in the bottom of the hopper opening into the upper part of the container.

7. The device of claim 1 wherein the input means includes at least one feed tube which has one end connected through the separator hopper above the center thereof and adjacent the permeable support, and the other end of the feed tube is supported in a coal-rock mix receiving housing.

8. The device of claim 7 wherein the input means further includes a second feed tube having an output end connected to the hopper below the permeable support of the separator hopper and an input end supported in the coal-rock mix receiving housing adjacent the input end of the first feed tube; and gate means provided within the mix receiving housing to alternately open the inputs of the two feed tubes.

9. The device of claim 8 wherein at least a portion of the mix receiving housing is mounted below the separator hopper for receiving the return water from the discharge means for re-use thereof.

10. The device of claim 9 wherein additional feed water means is provided to continually add fresh water to the system.

11. The device of claim 10 wherein the additional feed water means includes a water pump connected to a water source and having a discharge connected to the paddle blade structure within the discharge means cylindrical container.

12. The device of claim 11 wherein one of the separate compartments in the hopper also includes rock gate means for controlling the buildup of the separated rock within said hopper.

13. The device of claim 12 wherein the rock gate means includes, a solid particle gate, an air piston connected to said gate to actuate same, an air pump, a float, and an air valve connected to the float for actuation of the rock gate means.

14. The devices of claim 13 wherein the fresh water input paddle wheel structure in driven from motor means arranged with a suitable speed reduction unit so that the paddle wheel structure is rotatable within the discharge cylindrical container at a slow rpm.

* * * * *